United States Patent [19]

Nolte et al.

[11] Patent Number: 4,991,886

[45] Date of Patent: Feb. 12, 1991

[54] WINDOW LOCK

[75] Inventors: Douglas A. Nolte, Owatonna; Peter E. Braun, Faribault, both of Minn.

[73] Assignee: Truth Incorporated, Owatonna, Minn.

[21] Appl. No.: 535,282

[22] Filed: Jun. 7, 1990

Related U.S. Application Data

[63] Continuation of Ser. No. 297,490, Jan. 17, 1989, abandoned.

[51] Int. Cl.[5] ..... E05C 9/02

[52] U.S. Cl. ..... 292/161; 403/348; 403/353; 292/DIG. 33

[58] Field of Search ..... 292/DIG. 33, 161, 193, 292/160, 159, 156, 143, 173; 403/348, 353, 393

[56] References Cited

U.S. PATENT DOCUMENTS

| | | | |
|---|---|---|---|
| 389,646 | 9/1888 | Gunniss | 292/143 |
| 718,101 | 1/1903 | Decker | 292/161 |
| 1,878,881 | 9/1932 | Moore | 292/DIG. 41 X |
| 2,114,645 | 4/1938 | Van Benschoten | 268/117 |
| 4,095,829 | 6/1978 | Van Klompenburg | 292/241 |
| 4,497,141 | 2/1985 | Jarby | 403/348 X |

FOREIGN PATENT DOCUMENTS

| | | | |
|---|---|---|---|
| 462835 | 4/1951 | Italy | 292/161 |
| 583821 | 12/1946 | United Kingdom . | |

*Primary Examiner*—Richard E. Moore

*Attorney, Agent, or Firm*—Wood, Phillips, Mason, Recktenwald & Van Santen

[57] ABSTRACT

A window lock having plural ramped keepers for a window sash and plural rollers movably associated with a slider mountable on a window frame to provide multi-point locking. The ramped keepers are constructed and related to enable delayed lock-up of one roller and ramped keeper relative to the other in order to assure locking of racked or warped windows. A roller and associated ramped keeper are bevelled to counteract any flexibility that might be encountered in a flexible window, such as a window made of vinyl. The actuating mechanism provides for toggle positioning of the rotatable actuating handle and associated drive link to prevent movement of the lock mechanism by outside forces other than the handle. One or more tie bars, each having a roller, can be associated with the slider to provide for variation in the number of locking points and with further variations being achieved by the length of the tie bars as well as the number of rollers mounted thereon.

16 Claims, 1 Drawing Sheet

WINDOW LOCK

This application is a continuation of application Ser. No. 297,490, filed Jan. 17,1989 now abandoned.

FIELD OF THE INVENTION

This invention pertains to a window lock and, more particularly, to a window lock which provides for multi-point sequential locking of a window sash to a window frame. Additionally, the window lock provides for improved locking at each of the locking points.

BACKGROUND OF THE INVENTION

Movable windows in general use have sash which are either sliding, double hung or pivotal, with the latter type including awning and casement windows. Many different forms of window locks are available for locking a movable window.

The assignee of the invention disclosed herein markets window locks for such movable windows. In many instances, the window can be of such size or of a structural material which renders it desirable to have multi-point locking. It is known to mount individual window locks at spaced points or locations on the window to achieve multi-point locking. Typically, each of the window locks is independently operable. However, the movable mechanisms of a pair of window locks can be connected together for simultaneous movement from a single handle as shown in the Van Klompenburg U.S. Pat. No. 4,095,829, owned by the assignee of this invention.

Multi-point locking is shown in the Van Benschoten U.S. Pat. No. 2,114,645. There are commercially-available multi-point window lock structures operable by a single handle.

The foregoing prior art does not disclose structure providing for sequential locking of the multi-point locking structure to provide for a delayed lock-up to accommodate racked or warped windows, nor do such structures have a window lock constructed to counteract flexibility of the window structure as may be encountered with a vinyl window.

SUMMARY OF THE INVENTION

A primary feature of the invention is to provide a window lock having improved locking functions for locking a window sash to a window frame and, more particularly, to a window lock constructed to provide for multi-point locking to lock a window sash to a window frame at spaced locations, with delayed lock-up of one lock structure relative to the other to accommodate racked or warped windows and with the structure also taking into account other considerations which may arise in locking of a window having some flexure, such as a vinyl window.

Additional features of the invention relate to the versatility of the window lock in providing for simple, selective assembly of components to achieve the desired number of locking points; the assurance that the window lock mechanism cannot move by any force applied thereto other than by an operating handle; the sealing of a window lock housing to the window frame to render the window lock light, water and airtight; and an arrangement of the operating mechanism operable by the handle whereby the handle can have two limit positions wherein, in one limit position, the handle establishes a locked condition of the window with the handle close to the window frame and, in going to the other limit position, wherein the window is unlocked, the handle has moved through an arc approaching 180° wherein there is limited protrusion of the handle outwardly of the housing when the window is unlocked.

An object of the invention is to provide a new and improved window lock.

Another object of the invention is to provide a new and improved multi-point window lock and, more particularly, such a window lock for vinyl windows.

A further object of the invention is to provide a window lock for a window having a window frame and a movable window sash comprising, a slider having a cam member, a ramped keeper, and means for moving the slider in a path extending lengthwise thereof to cause the cam member to coact with the ramped keeper in establishing either a locked or unlocked condition of the window; the improvement comprising: multi-point locking of the window sash to the window frame by utilization of at least two of said ramped keepers and two of said cam members, each of said ramped keepers having an inclined ramp section and a generally planar section, and said slider having a length of movement along said path greater than that required to move a cam member along said ramp section and onto a generally planar section of a ramped keeper whereby delayed lock-up of one cam member and associated ramped keeper may be achieved relative to the other cam member and ramped keeper by having said ramped keepers at a distance apart greater than the distance between said cam members and a planar section of a ramped keeper having a length greater than said difference in distances.

Still another object of the invention is to provide a window lock for a window having a window frame and a movable window sash comprising, a slider having a cam member, a ramped keeper, and means for moving the slider in a path extending lengthwise thereof to cause the cam member to coact with the ramped keeper in establishing either a locked or unlocked condition of the window; the improvement comprising: a housing; a handle rotatably mounted on said housing for movement between two limit positions and operable to move said slider along said path and said slider and handle having coacting means to preclude gravity or other outside force from moving said slider along said path without moving said handle.

An additional object of the invention is to provide a window lock for a window having a window frame and a movable window sash comprising, a slider having a cam member, a ramped keeper, and means for moving the slider in a path extending lengthwise thereof to cause the cam member to coact with the ramped keeper in establishing either a locked or unlocked condition of the window; the improvement comprising: each of said cam member and ramped keeper being bevelled to resist any separating movement in a direction normal to said path as a result of flexibility of the window frame and window sash as may result due to high loads.

DESCRIPTION OF THE DRAWINGS

FIG. 10 is a fragmentary, perspective view of a window shown in the closed position having the window lock structure of FIGS. 2-7 associated therewith.

DESCRIPTION OF THE PREFERRED EMBODIMENT

Figures 1, 2, 3, 4, 5, 6, 7, 8, 9:
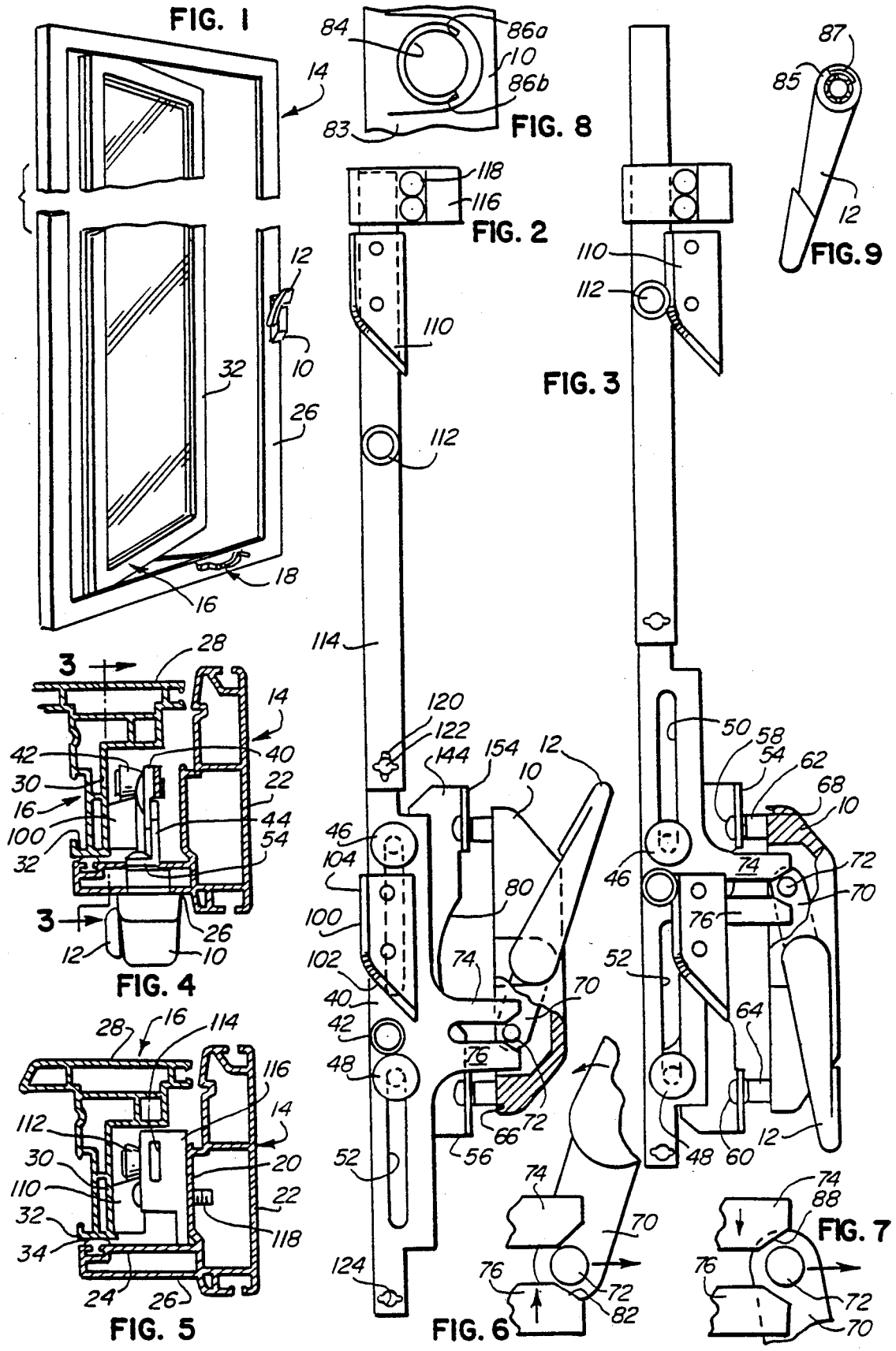
FIG. 1 is a fragmentary, perspective view of a window shown in open position and which has the window lock structure of FIGS. 2–7 associated therewith.
FIG. 2 is a side elevation of the window lock hardware shown without association with the window sash and window frame and with the window lock in unlocked position and being a view generally similar to that of FIG. 3 and with parts broken away.
FIG. 3 is a view similar to FIG. 2 showing the window lock hardware in window-locking position and with the view being taken generally along the line 3—3 in FIG. 4.
FIG. 4 is a sectional view taken generally along the line 4—4 in FIG. 10; and showing the structure in association with the window frame and window sash.
FIG. 5 is a view similar to FIG. 4 and taken generally along the line 5—5 in FIG. 10.
FIG. 6 is a fragmentary diagrammatic view of a part of the structure as positioned as shown in FIG. 2 and illustrating a first toggle position.
FIG. 7 is a view similar to FIG. 6 and illustrating a second toggle position for the structure in window lock position and as shown in FIG. 3.
FIG. 8 is a fragmentary elevation of the housing.
FIG. 9 is an elevation view of the handle.

The window lock is shown in association with a window in FIG. 1 and with the only room-visible part thereof being a housing 10 and a handle 12.

The window has a window frame, indicated generally at 14, in which the window sash, generally indicated at 16, of a casement window is pivotally mounted. The mounting of such a window by hinges is well known in the art as well as use of a window operator, indicated generally at 18, for moving the window sash between closed and fully open positions or any desired position therebetween.

As will be readily recognized, the window lock can also be used for an awning-type window wherein the pivotal movement of the window sash would be generally about a horizontal axis, rather than the vertical axis of the casement window. The concepts embodied in the window lock could be utilized with other types of movable windows, such as a double hung window.

The window lock has particular utility with a vinyl window and an embodiment of a vinyl window is shown fragmentarily in FIGS. 4 and 5. The window frame 14 has vertical wall sections 20 and 22 suitably integrally interconnected by interconnecting walls and with a pair of interconnected vertical walls 24 and 26 extending at right angles thereto and with the wall 26 defining a room-facing surface of the window frame.

The window sash 16 has a vertical exterior wall 28 with integrally associated walls including a wall 30 extending normal thereto which defines one of the walls mounting a vertical face panel 32 which can be brought closely adjacent to the vertical frame wall 24 when the window is closed and with a suitable weather strip 34 assuring a tight seal.

The window lock has a slider 40 movable in a path extending lengthwise thereof and which mounts a cam member, in the form of a roller 42. The slider 40 is movable in said path by its mounting on a planar part of a bracket 44 which mounts a pair of shouldered guide rivets 46 and 48 which extend through the respective slider slots 50 and 52, respectively, and which enable movement of the slider from the window unlocked position, shown in FIG. 2, to the window locked position, shown in FIG. 3.

The bracket 44 has a pair of bracket flanges 54 and 56 at right angles to the planar part thereof which can receive a pair of fasteners 58 and 60, respectively, which thread into a pair of alignment bosses 62 and 64 extending inwardly from the housing 10 and which fit into a slot formed in the walls 24 and 26 of the window frame. The inner face of the housing 10 extends beyond the perimeter of the opening in the window frame to abut against the interior room face of the vertical frame wall 26. The fasteners 58 and 60 can draw the bracket flanges 54 and 56 against the inner face of the frame wall 24 and the perimeter of the housing 10 against the wall 26 to capture the window frame therebetween. The perimeter part of the housing which bears against the wall 26 includes a continuous O-ring groove, parts of which are shown at 66 and 68 and which receive an O-ring to effect a light, water and airtight seal between the housing and the window frame.

The housing 10 rotatably mounts the handle 12 for movement between two limit positions. One of these limit positions is the window locked position, as shown in FIG. 3, wherein the handle 12 extends doWnwardly and generally parallel to the frame wall 26. The handle can move to its other limit position, as seen in FIG. 2, which is the window unlocked position. This movement of the handle is through an arc approaching 180° whereby the handle, as seen in FIG. 2, barely extends beyond the housing 10 and, thus, does not protrude into the room when the window is open.

The slider 40 and handle 12 have coacting means whereby rotation of the handle results in linear movement of the slider along the path lengthwise of the slider. This coacting means comprises a drive link 70 splined to the handle at its rotation axis and which has a pin 72 which coacts with a forked section of the slider. This forked section has a pair of tines 74 and 76 with an open-ended slot therebetween. With the window lock in locked condition and with the handle 12 in the position shown in FIG. 3, the handle can be rotated in a counterclockwise direction to the position shown in FIG. 2 and, during this rotation, the pin 72 will move sequentially inwardly and outwardly of the slot and in engagement with the tine 76 to move the slider 40 downwardly, as viewed in FIGS. 2 and 3. In return of the handle 12 to the position of FIG. 3, the handle 12 is rotated clockwise and the pin 72 moves sequentially inwardly and outwardly of the slot and coacts with an edge of the tine 74 to raise the slider, as viewed in FIGS. 2 and 3. The planar part of the bracket 44 has an arcuate cut-out 80 to permit the free end of the drive link 70 to move between the positions shown in FIGS. 2 and 3.

The ends of the tines 74 and 76 of the forked section of the slider are bevelled to enable movement of the drive link 70 to a toggle position in either of the limit positions of the handle. This is diagrammatically illustrated in FIGS. 6 and 7. With the handle 12 moving to the window unlocked position of FIG. 2, the drive pin 72 moves in a counterclockwise direction, as viewed in FIG. 6, and the downward arc to a toggle position is permitted by the bevelled end 82 of the tine 76. The pin 72 has reached a toggle position wherein, if an upward force is exerted on the slider 40 as indicated by the upwardly-directed arrow, the bevelled end 82 of the tine 76 engages the pin 72 and tends to move the pin toward the right. This movement is prevented by coaction between the housing and the handle.

This coaction is achieved by structure shown in FIGS. 8 and 9. FIG. 8 shows a side wall 83 of the housing 10 having an opening 84 to receive a stem 85 (FIG. 9) of the handle 12. A pair of abutments 86*a* and 86*b* are formed on the housing to define rotatable limit positions for the handle 12 by coaction with an arcuate rib 87 on the handle. The rib 87 has an included arc of approximately 104°, although not intended to be limiting, and the abutments 86*a* and 86*b* are spaced apart through an angular distance of approximately 250° whereby the handle can rotate through an arc of approximately 150°.

A similar toggle position is achieved when the handle 12 is in window locked position. As seen in FIG. 7, any downward force applied on the slider 40, as represented by the downwardly-directed arrow, would cause a bevelled end 88 of the tine 74 to engage the drive pin 72 and urge the drive link 70 in a clockwise direction, as indicated by the arrow, which would be prevented by coaction of the handle 12 with the housing 10. The slider 40 cannot be moved by any outside force other than by handle movement.

The previously-mentioned cam member on the slider 40, which is the roller 42, coacts with a ramped keeper 100 which is mounted by suitable means to the vertical wall 30 of the window sash. The ramped keeper has an inclined ramp section 102 and a generally planar section 104. The ramped keeper 100 is shown in FIG. 2 in relation to the roller 42 when the window sash is not fully closed. With clockwise rotation of the handle 12 toward the locked position shown in FIG. 3, the slider 40 moves upwardly and the roller 42 engages the inclined ramp section 102 and rolls therealong to draw and maintain the window sash fully closed when the roller 42 moves onto the generally planar section 100 of the ramped keeper. The ramped keeper can be a solid member, as shown, or can be shaped from a metal plate.

In order to achieve multi-point locking, the window sash mounts a second ramped keeper 110 having the same construction as the ramped keeper 100 and at a distance therefrom A second cam member, in the form of a roller 112, coacts with the ramped keeper 110. This roller 112 is rotatably-mounted on a tie bar 114 which is connected to an end of the slider 40 for lengthwise movement therewith. An upper end of the tie bar is movable within a tie bar guide 116 which is fastened to the frame wall 20 by fasteners 118.

Versatility in the location of points of locking is achieved by the manner in which a tie bar 114 may be associated with the slider 40.

The tie bar 114 has a slot 120 at the lower end thereof which extends lengthwise of the tie bar. A tie bar rivet 122 is fixed to an offset upper end of the slider 40 and has a pair of aligned ears at a distance from the slider. With the tie bar 114 at an angle to the slider, the slot 120 can be aligned with the aligned ears of the tie bar rivet and the tie bar then moved past the ears and, thereafter, rotated to an alignment position, with the aligned ears then locking the tie bar 114 to the slider. There is also a tie bar rivet 124 at the lower end of the slider. The tie bar 114 can thus extend downwardly from the slider 40. Two tie bars can be used. Further variations can be achieved by the use of additional rollers with each tie bar (and additional ramped keepers) and the use of varying length tie bars.

The multi-point locking is achieved with delayed lock-up of the roller 112 and ramp keeper 110 relative to the roller 42 and ramped keeper 100 by the slider having a length of movement along its path greater than that required to move a roller along the inclined ramp section 102 and onto a generally planar section 104 of a ramped keeper and having the ramped keepers at a distance apart greater than the distance between the rollers. A generally planar section of a ramped keeper has a length greater than the differences in the distances to provide a dwell for one roller while the other roller is on an inclined ramp section.

An added feature with particular utility for a vinyl window because of the flexibility thereof is the bevelling of the rollers 42 and 112 and the generally planar sections 104 of the ramped keepers, as seen in FIGS. 4 and 5, to resist separation therebetween in a direction normal to the path of the slider 40. Referring more particularly to FIG. 4, any tendency of the window sash to move toward the left, which would cause separation between the ramped keeper and the roller, is resisted by the bevelled relation therebetween.

The sequential locking action at the multiple lock points has a further advantage in limiting the maximum amount of force required at any one time to achieve the full locking of the window.

From the foregoing, it will be evident that a window lock with extreme versatility and providing for multi-point locking has been provided.

With the structure of the ramped keepers having the elongate generally planar sections providing an elongate dwell, there is an enhanced versatility in that the ramped keepers can be located in a desired relation to achieve the desired sequence of locking at various locking points. The tie bars can be provided in different lengths and with different numbers of rollers thereon and the desired tie bars can readily be associated with the slider at either the top or bottom thereof with the simple rotation connection which does not require the use of any attaching screws between the tie bar and the slider.

We claim:

1. A window lock for a window having a window frame and a movable window sash comprising, a slider having a cam member, a ramped keeper, and means for moving the slider in a path extending lengthwise thereof to cause the cam member to coact with the ramped keeper in establishing either a locked or unlocked condition of the window; the improvement comprising: multi-point locking of the window sash to the window frame by utilization of at least two of said ramped keepers and two of said cam members, each of said ramped keepers having an inclined ramp section and a generally planar section, and said slider having a length of movement along said path greater than that required to move a cam member along said ramp section and onto a planar section of a ramped keeper whereby delayed lock-up of one cam member and associated ramped keeper may be achieved relative to the other cam member and ramped keeper by having said ramped keepers at a distance apart greater than the distance between said cam members, and a planar section of a ramped keeper having a length greater than said difference in distances.

2. A window lock as defined in claim 1 wherein said cam members and ramped keepers are bevelled to resist separation in a direction normal to said slider path.

3. A window lock as defined in claim 1 wherein said cam members are rollers.

4. A window lock as defined in claim 1 including a tie bar, one of said cam members being mounted on said tie bar, means for connecting a tie bar to an end of the slider, and a tie bar guide for guiding the tie bar at a location remote from said slider.

5. A window lock as defined in claim 4 wherein the means for connecting a tie bar to an end of the slider comprises a slot on the tie bar, a tie bar rivet non-rotatably fixed to the slider and having a pair of aligned ears at a distance from and extending transversely to the slider path whereby the tie bar can be placed at an angle to the slider to align the slot with and pass the slot over the ears and thereafter rotation of the tie bar to alignment with the slider locks the slider and tie bar together.

6. A window lock as defined in claim 5 wherein there are a pair of said tie bar rivets located one at each end of said slider whereby a single tie bar can be mounted at one end of the slider or a pair of tie bars can extend from opposite ends of the slider.

7. A window lock as defined in claim 1 wherein said cam members are rollers and the rollers and ramped keepers have engaging bevelled surfaces.

8. A window lock as defined in claim 1 and having a housing; a handle rotatably mounted on said housing for movement between two limit positions and operable to move said slider along said path and said slider and handle having coacting means to preclude gravity or other outside force from moving said slider along said path without moving said handle.

9. A window lock as defined in claim 8 wherein said coacting means comprises a forked section of said slider with a pair of tines spaced apart by a slot, a pivotal drive link operable by the handle and having a pin movable in an arc and along said slot, and said tines each having a bevelled free end to enable movement of the pin in its arc without movement of said slider to place the drive link in a toggle position wherein an outside force on the slider is reacted by engagement between a bevelled free end of a tine and said pin and the handle being in a limit position.

10. A window lock as defined in claim 9 wherein said handle has one limit position extending generally parallel to said slider path when the window is locked and the handle moves through an arc to the other limit position to unlock the window, said arc approaching 180° to limit handle protrusion into a room when the window is open.

11. A window lock as defined in claim 1 including a housing mountable on the window frame and having alignment bosses positionable in an opening in the window frame, a bracket positionable within the window frame, means connecting the bracket and housing bosses together with a part of the window frame captured therebetween, coacting means on the bracket and slider mounting the slider for movement along said path, and an O-ring groove in said housing shaped to surround said opening in the window frame and which receives an O-ring to seal the housing to the window frame.

12. A window lock for a window having a window frame and a movable window sash comprising, a slider having a cam member, a ramped keeper, and means for moving the slider in a path extending lengthwise thereof to cause the cam member to coact with the ramped keeper in establishing either a locked or unlocked condition of the window; the improvement comprising: a housing; a handle rotatably mounted on said housing for movement between two limit positions and operable to move said slider along said path and said slider and handle having coacting means operable in both limit positions of the handle to preclude any force other than that applied by the handle such as gravity or other outside force from moving said slider along said path.

13. A window lock as defined in claim 12 wherein said coacting means comprises a forked section of said slider with a pair of tines spaced apart by a slot, a pivotal drive link operable by the handle and having a pin movable in an arc and along said slot, and said tines each having a bevelled free end to enable movement of the pin in its arc without movement of said slider to place the drive link in a toggle position wherein an outside force on the slider is reacted by engagement between a bevelled free end and said pin and the handle being in a limit position.

14. A window lock as defined in claim 12 wherein said handle has one limit position extending parallel to said slider path when the window is locked and the handle moves through an arc to the other limit position to unlock the window, said arc approaching 180° to limit handle protrusion into a room when the window is open.

15. A window lock for a window having a window frame and a movable window sash comprising, a slider having a roller defining a cam member, a ramped keeper, and means for moving the slider in a path extending lengthwise thereof to cause the cam member to coact with the ramped keeper in establishing either a locked or unlocked condition of the window; the improvement comprising: each of said cam member and ramped keeper being bevelled to resist any separating movement in a direction normal to said path as a result of flexibility of the window frame and window sash as may result due to high loads.

16. A window lock as defined in claim 15 and having a plurality of said ramped keepers, a tie bar connected to said slider for movement therewith along said path and a roller on said tie bar for coaction with a ramped keeper, and said ramped keepers each having an inclined ramp section for window sash pull-in and a generally planar section which may extend in parallel relation with said path whereby one of said rollers may move along a keeper generally planar section of one of said ramped keepers while another roller is moving along an inclined ramp section of another of said ramped keepers, each of said inclined ramp section and generally planar section of a ramped keeper having said bevel, and said slider and tie bar having movement along said path substantially greater than that required to cause a roller to move along an inclined ramp section and onto a generally planar section of a ramped keeper.

* * * * *

UNITED STATES PATENT AND TRADEMARK OFFICE

CERTIFICATE OF CORRECTION

PATENT NO. : 4,991,886

DATED : February 12, 1991

INVENTOR(S) : Douglas A. Nolte and Peter E. Braun

It is certified that error appears in the above-identified patent and that said Letters Patent is hereby corrected as shown below:

Please add attached Figure 10.

Signed and Sealed this

Twenty-first Day of July, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,991,886

DATED : February 12, 1991

INVENTOR(S) : Douglas A. Nolte and Peter E. Braun

It is certified that error appears in the above-identified patent and that said Letters Patent is hereby corrected as shown below:

Please add Figure 10 as follows:

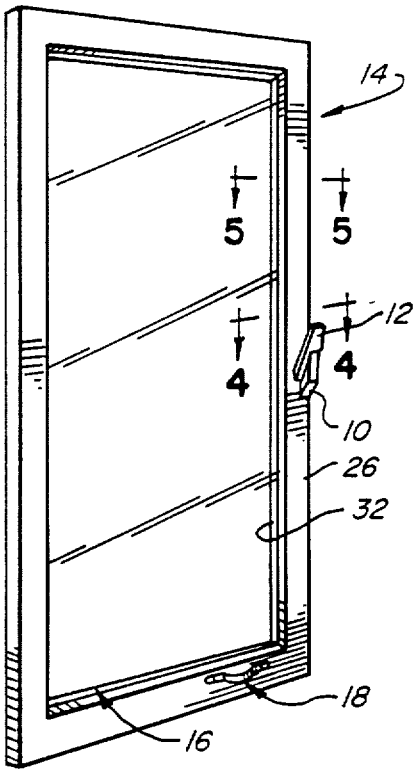

FIG. 10